United States Patent [19]

Lin et al.

[11] Patent Number: 4,705,578

[45] Date of Patent: Nov. 10, 1987

[54] METHOD OF CONSTRUCTING A MAGNETIC CORE

[75] Inventors: Kou C. Lin, Hermitage, Pa.; Charles E. Burkhardt, Garden City, S.C.; Harry R. Sheppard, Hermitage, Pa.

[73] Assignee: Westinghouse Electric Corp., Pittsburgh, Pa.

[21] Appl. No.: 852,876

[22] Filed: Apr. 16, 1986

[51] Int. Cl.[4] ..... C21D 1/04

[52] U.S. Cl. ..... 148/108; 148/121; 24/609

[58] Field of Search ..... 148/108, 121, 122; 29/609

[56] References Cited

U.S. PATENT DOCUMENTS

| | | | |
|---|---|---|---|
| 4,116,728 | 9/1978 | Becker et al. | 148/108 |
| 4,197,146 | 4/1980 | Frischmann et al. | 148/108 |
| 4,201,837 | 5/1980 | Lupinski | 428/457 |
| 4,262,233 | 4/1981 | Becker et al. | 315/248 |
| 4,298,382 | 11/1981 | Stempin et al. | 75/226 |
| 4,413,406 | 11/1983 | Bennett et al. | 29/609 |
| 4,506,248 | 3/1985 | Lin | 336/233 |
| 4,528,481 | 7/1985 | Becker et al. | 315/248 |
| 4,529,457 | 7/1985 | Kushnick | 148/403 |
| 4,529,458 | 7/1985 | Kushnick et al. | 148/403 |

FOREIGN PATENT DOCUMENTS

| | | | |
|---|---|---|---|
| 57-79158 | 5/1982 | Japan | 148/121 |
| 60-248817 | 12/1985 | Japan | 148/108 |

OTHER PUBLICATIONS

"Utilization of Amorphous Metals in Electric Motors", by L. A. Johnson, U.S. Department of Energy Contract No. W-7405-eng.-26, published Mar. 1984.

*Primary Examiner*—John P. Sheehan
*Attorney, Agent, or Firm*—D. R. Lackey

[57] ABSTRACT

A method of constructing a magnetic core from groups of amorphous metal laminations, with the groups being defined by flattening sheets which are interspersed in a stack of amorphous laminations during a magnetic stress-relief anneal cycle. The stack of laminations is compressed with a pressure of at least about 4 psi, but not enough pressure to metallurgically bond adjacent laminations. The compression step is applied to the stack of laminations at least during the time the stack is at the elevated soaking temperature of the stress-relief anneal cycle. The flattened laminations are used to construct a magnetic core having an improved space factor and reduced sensitivity to core clamping pressures.

10 Claims, 12 Drawing Figures

METHOD OF CONSTRUCTING A MAGNETIC CORE

BACKGROUND OF THE INVENTION

1. Field of the Invention

The invention relates in general to static electrical inductive apparatus, such as electrical transformers, and more specifically to new and improved methods of constructing magnetic cores for such apparatus.

2. Description of the Prior Art

The core losses in the electrical transformers used by electric utility companies represent a significant loss of the energy generated, even though electrical transformers are highly efficient. With the increasing value of energy, ways of reducing these losses are constantly being sought. The use of amorphous metal in the magnetic cores of electrical power transformers appears to be attractive, because at equivalent inductions the no-load core losses of electrical grade amorphous metals are only about 25% to 30% of the losses of conventional grain-oriented electrical steels.

Amorphous metals, however, in addition to their higher initial cost than conventional electrical steels, also pose many manufacturing problems which are not associated with conventional grain-oriented steels. For example, amorphous metal is very thin, being only about 1 to 1.5 mils thick, it is very stress sensitive, with the losses and excitation power of cores constructed of amorphous metal both being adversely affected by mechanical stresses; and, it is very brittle, especially after stress-relief anneal. These characteristics create many manufacturing problems, especially in constructing magnetic cores of the stacked type. A large number of laminations must be stacked, even to reach a build of 1 inch, for example, making it very time consuming to stack power transformer cores, which usually have build dimensions of several inches. Further, the large number of laminations in the core build results in a relatively low space factor, compared with a core constructed of conventional grain oriented electrical steel. Amorphous laminations are not perfectly flat, nor are they are perfectly smooth. Amorphous laminations have ripples and dimples, as well as surface irregularities. These characteristics, along with the large number of lamination-to-lamination interfaces, cause the relatively low space factor. Clamping the amorphous core to increase the space factor applies stresses to the core, which in turn increase both the core losses and the exciting volt amperes required to magnetize the core.

The prior art has tried many different approaches to decrease the time required to stack a core using amorphous laminations, as well as to increase the space factor. Laminate composites, using polymers or metals having a low melting point to bond a plurality of laminations into a single lamination, make it easier to stack a core, but anything placed between the laminations reduces the space factor. Metallurgically bonding a plurality of amorphous laminations to create a composite lamination solves the problem of introducing a foreign substance between the laminations, but such a construction may increase eddy current losses, apparently because the beneficial effect of having a large number of thin laminations is partially lost by the metal-to-metal contact provided by the metallurgical bonds.

Thus, it would be desirable to provide a new and improved method of constructing magnetic cores for power transformers using amorphous alloys, which method would improve the core space factor while reducing the sensitivity of the core to the clamping stresses required to achieve and maintain a satisfactory space factor.

SUMMARY OF THE INVENTION

Briefly, the present invention is a new and improved method of constructing a magnetic core for static electrical inductive apparatus, such as power transformers, which method includes the step of pressure annealing the amorphous laminations before they are stacked into a magnetic core. In a preferred embodiment, the amorphous laminations are stress relief annealed in an edge aligned stack. Flattening sheets formed of a non-amorphous material are interspersed in the stack such that every 5 to 10 amorphous laminations are separated by a flattening sheet. Pressure is applied to the stack, at least while the stack is at the desired stress-relief anneal temperature. The pressure, in a preferred embodiment is at least about 4 psi, with the maximum pressure being low enough that metallurgical bonding does not occur. In general, the maximum pressure is about 100 psi.

A magnetic core is constructed from the pressure annealed amorphous laminations. The flattening sheets are not used in the magnetic core. The magnetic core has different layer configurations, in order to prevent the layer joints from being aligned throughout the core build. In a preferred embodiment, the number of laminations per core layer, before the layer joint configuration is changed, is the same as the number of laminations which were pressure annealed as a group, i.e., the number of amorphous laminations between any two adjacent flattening laminations. This pressure annealed group of amorphous laminations is conveniently handled and stacked into the magnetic core as a group. Magnetic cores constructed of pressure annealed groups of amorphous laminations show an improved space factor, and an improvement in core loss in watts per pound W/#). Without a significant increase in exciting power at the recommended operating inductions which range from 13 to 14 kG.

BRIEF DESCRIPTION OF THE DRAWINGS

The invention may be better understood, and further advantages and uses thereof more readily apparent, when considered in view of the following detailed description of exemplary embodiments, taken with the accompanying drawings in which.

DESCRIPTION OF THE PREFERRED EMBODIMENTS

Figure 1:
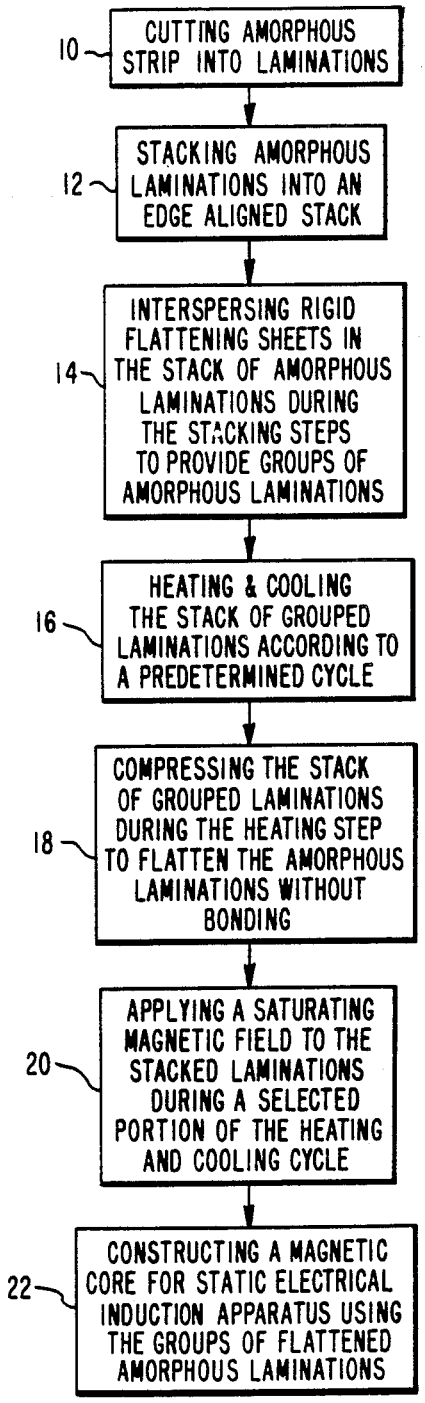
FIG. 1 is a block diagram setting forth the method steps of a preferred embodiment of the invention.

Referring now to the drawings, and to FIG. 1 in particular, there is shown a block diagram which outlines the method steps of constructing a magnetic core according to a preferred embodiment of the invention. Step 10 cuts laminations from a reel of amorphous metal, such as amorphous alloy strip 2605 S-2, for example, available from Allied Metglas Products, Parsippany, N.J. 07054 (Metglas is a registered trademark of Allied Corporation). The laminations are cut to the desired length from strip having the desired width. The laminations are cut at the desired angle relative to the longitudinal dimension of the strip, i.e., relative to the lateral edges of the strip. For example, some of the laminations may have one or both ends cut perpendicular to the lateral edges, and others may be cut at an acute angle, such as 45 degrees, to provide a miter joint. The different end configurations and different lamination lengths may then be assembled to provide a plurality of different lamination layers from the viewpoint of joint configuration, with each different lamination layer including one or more identical superposed layers before the layer joint configuration is changed. Since amorphous laminations are so thin, as a practical matter a plurality of like dimensioned laminations will be stacked at a time, and thus each joint configuration will usually be repeated through several adjacent layers before the layer joint configuration is changed.

Figure 2A:
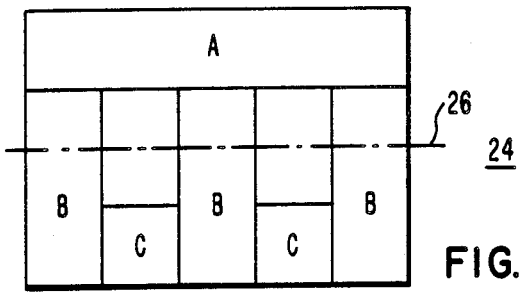
FIGS. 2A, 2B, and 2C set forth examples of lamination layers having different joint configurations which may be used in constructing a magnetic core according to the invention.
Figure 2B:
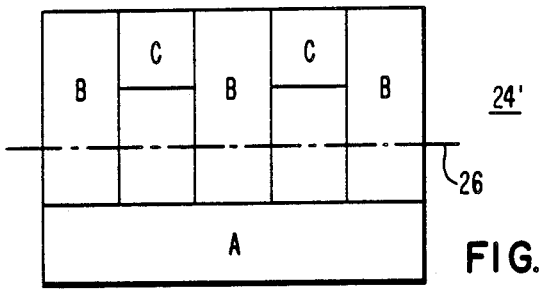
Figure 2C:
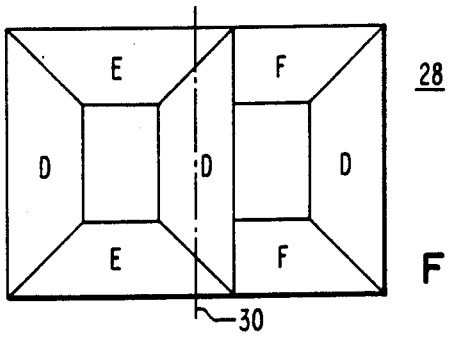

FIGS. 2A, 2B, and 2C illustrate lamination layers having different exemplary layer joints, but any desired joint configuration may be used. FIG. 2A illustrates a lamination layer 24 which is made up of three different laminations A, B, and C, all of which have ends cut perpendicular to the lateral edges of the laminations. FIG. 2B illustrates a lamination layer 24' which is the same as layer 24 shown in FIG. 2A, except it is rotated 180 degrees about axis 26 which is disposed perpendicularly through the core leg portions B. FIG. 2C illustrates a lamination layer 28 which is made up from three laminations D, E and F, all of which have mitered ends. Instead of repeating layer 28 the next time it is due in the sequence, it may be rotated 180 degrees about axis 30 which is disposed perpendicularly through the core yoke portions, i.e., along the longitudinal axis of the inner leg which includes lamination D. This will provide an additional joint configuration for the inner leg in both the upper and lower yoke portions of the magnetic core.

Step 12 of FIG. 1 includes the step of stacking like configured and dimensioned amorphous laminations which were cut in step 10, with the edges of the stack being vertically aligned. Instead of making a tall stack of edge aligned laminations, however, step 14 of FIG. 1 introduces the concept of interspersing the amorphous laminations with rigid, smooth surfaced flattening sheets. In a preferred embodiment of the invention, the flattening sheets may be laminations of regular grain oriented electrical steel, such as M-4, having a thickness dimension in the normal range used to construct electrical power transformers, such as 7 to 12 mils.

Figure 3:
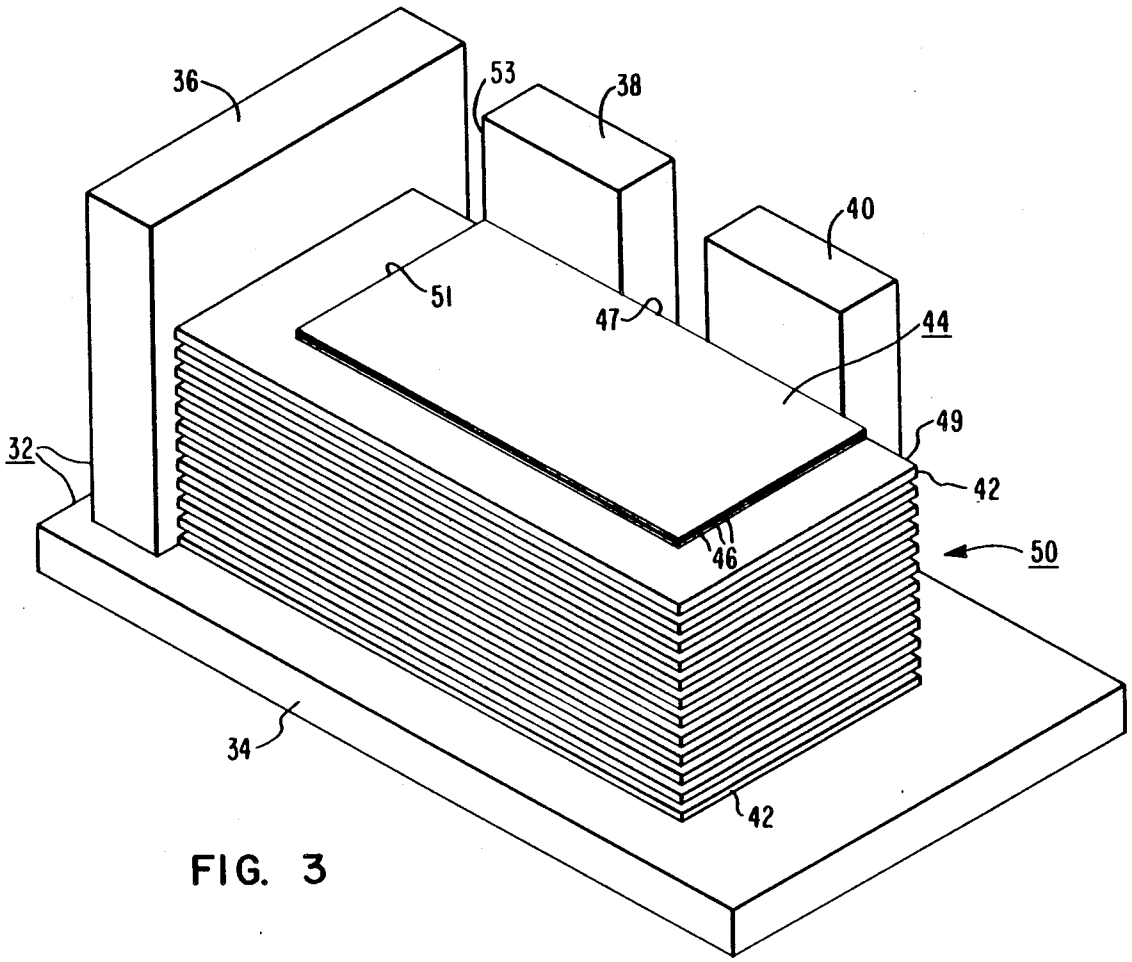
FIG. 3 is a perspective view illustrating the stacking of groups of amorphous laminations between flattening sheets.

FIG. 3 illustrates steps 12 and 14, implemented by a stacking fixture 32. Stacking fixture 32 includes a sturdy base member 34 and removable locating members 36, 38 and 40, which extend vertically upward from base member 34. A rigid, smooth surfaced flattening sheet 42 is placed on base member 34 with two of its edges located against the upright locating members 36, 38 and 40. For ease in stacking, the flattening sheets 42 are selected to be longer and wider than the amorphous laminations to be flattened. They are also selected to have a surface which is smoother than the surface of the amorphous laminations. Since amorphous strip is formed by chill chasting, its surfaces are relatively rough. Thus, it is not difficult to find flattening sheets which have a smoother surface than the amorphous laminations.

Like dimensioned amorphous laminations 46 are placed on the flattening sheet 42, using upright locating members 38 and 40 to align the lateral edges 47 of the laminations 46 with edge 49 of the flattening sheet 42.

It is also important that the amorphous laminations 46 be aligned with one another from group-to-group throughout the stack. Thus, one end of each of the amorphous laminations 46, such as end 51, is aligned with a corner of one of the locating members, such as corner 53 of locating member 38. Alignment of laminations 46 from group-to-group throughout the stack assures that all such laminations will be subjected to the same clamping pressure.

As will be hereinafter shown by test data, the number of laminations in each stack or group of amorphous laminations is at least about 5 and not more than about 10. The group of amorphous laminations is then covered by another flattening sheet 42, and another group of amorphous laminations is placed on this flattening sheet. This process is repeated until a predetermined stack height is obtained, with the final group 44 of amorphous laminations 46 being shown in position on a flattening sheet 42. Each group may have exactly the same number of amorphous laminations; or, since amorphous laminations are so thin, each group may be selected for stack height without regard to the actual number of laminations per group. Another flattening sheet (not shown in FIG. 3) is then placed on group 44 to complete a stack 50. The alignment members 36, 38 and 40 are then removed from base member 34 and a sturdy top member (not shown in FIG. 3 but referenced 34' in FIG. 4) similar to the base member 34 is placed on top of the resulting stack to sandwich the stack 50 of amorphous laminations, which include the interspersed flattening sheets, between the base and top members of the fixture 32.

Step 16 of FIG. 1 then subjects the stack 50 of amorphous laminations prepared according to steps 12 and 14 to a predetermined heating and cooling cycle. Instead of simply heating and cooling stack 50, however, step 18 of FIG. 1 introduces the concept of compressing stack 50, at least during the heating portion of the heating and cooling cycle. The compression step flattens the amorphous laminations 46 of the groups 44, and it reduces the surface roughness of the amorphous laminations, to improve the space factor of a magnetic core constructed therefrom.

Figure 4:
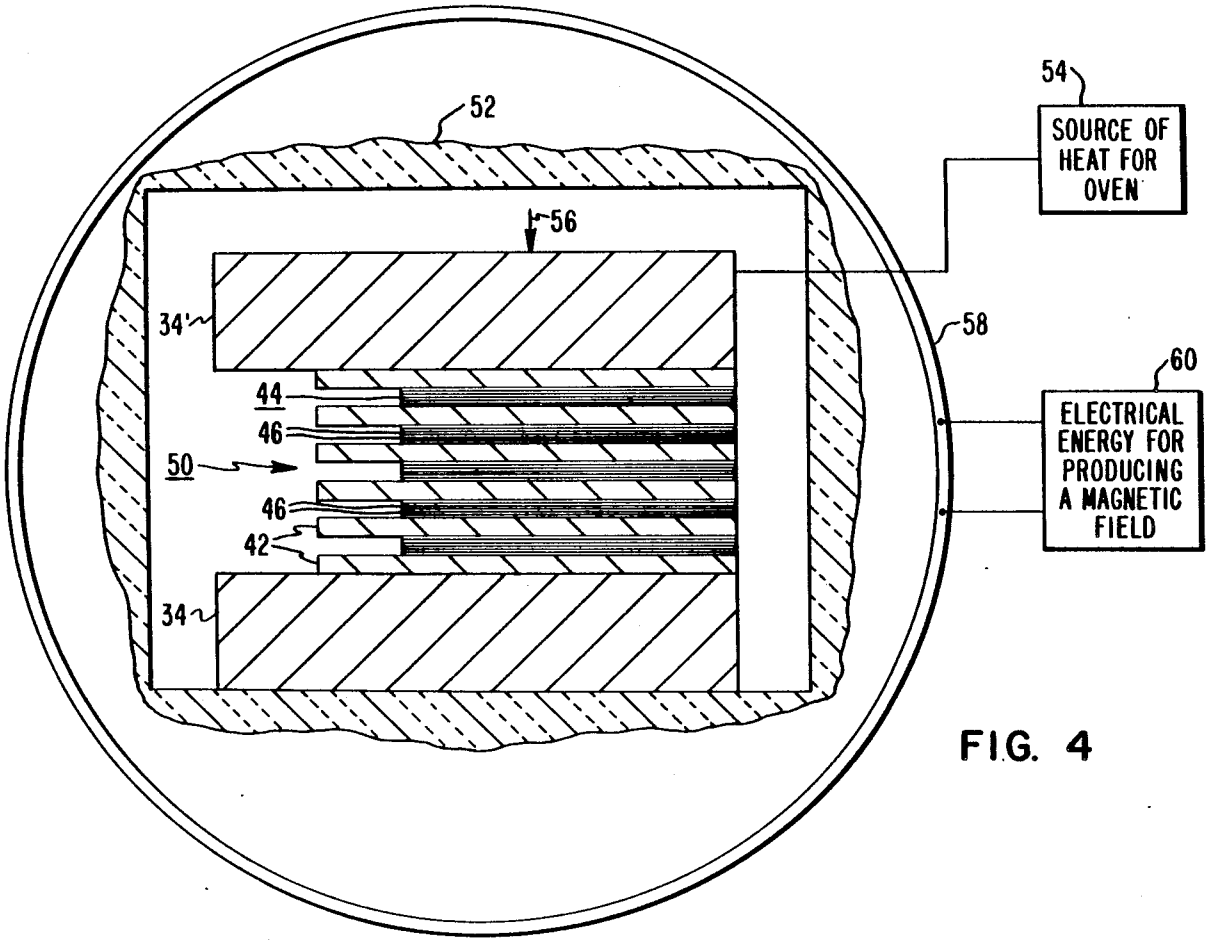
FIG. 4 is a cross sectional view of a stress-relief anneal oven containing a stack of amorphous laminations being flattened with pressure according to the teachings of the invention.

FIG. 4 sets forth an exemplary implementation of steps 16 and 18, with stack 50 being shown in an oven or furnace 52 having a source 54 of heat. For example, oven 52 may include electrical resistive elements (not shown), and the source 54 may be a source of electrical energy. Arrow 56 indicates that stack 50 is being compressed between the base and top members 34 and 34', respectively, of fixture 32. Test data indicates that the pressure should be at least about 4 psi, and preferably at least about 10 psi, with the upper maximum being below that pressure which would cause metallurgical bonds between adjacent amorphous laminations. It is important to prevent metallurgical bonding because of its potential in increasing eddy current losses in the resulting magnetic core. In general, the maximum pressure is about 100 psi.

The pressure represented by arrow 56 in FIG. 4 may be provided by any one of several different arrangements. It may simply be provided by a weight placed on the stack 50. It may be provided by elements such as springs and/or bolts which would extend between the base and top members 34 and 34' respectively. It may be provided by a press located outside the oven 52, which has a member which extends through an opening in oven 52 and into engagement with the top 34, etc.

Oven 52 may be of the batch type, or of the continuous type, as desired, with a protective inert atmosphere being provided therein, such as nitrogen. A typical heating and cooling cycle for amorphous alloys includes a heat-up cycle during which the amorphous metal laminations are brought up to a predetermined stress-relief anneal temperature below the crystallization temperature of the amorphous alloy being used. The stress-relief anneal temperature is usually in the range between 350 degrees C. and 400 degress C. The time required to reach the desired temperature depends upon the oven and the mass in the oven, but is usually 3 to 4 hours. The amorphous laminations are then held at the predetermined temperature for 1 to 2 hours, and it is during this soaking time that the pressure flattening results are obtained. Thus, it is only necessary to apply the compressive forces during this portion of the cycle. The compressive forces may be applied throughout the complete heating and cooling cycle, however, without detriment. The amorphous laminations are then allowed to cool naturally to about 200 degrees C., while still in the protective atmosphere of the oven 52, without any means for controlling the rate, after which the amorphous laminations may be removed from the oven 52.

In a preferred embodiment of the invention, the amorphous laminations are subjected to a saturating magnetic field during predetermined portions of the heating and cooling cycle, such as during the heat-up, soaking, and cooling portions of the cycle. This step is illustrated as step 20 in FIG. 1, and is shown being implemented in FIG. 4 with an electrical coil 58 encircling the stack 50 while it is in the oven 52. Coil 58 is connected to a suitable source 60 of electrical energy. A field of about 10 orsteads has been found to be suitable, with the direction of the field being in the direction of the longitudinal axis of the leg or yoke laminations being processed. While the Figures illustrate only one stack of amorphous laminations between the flattening sheets, it is to be understood that more than one group may be disposed between each adjacent pair of flattening sheets. If more than one group is placed between adjacent flattening sheets, they should all have the same orientation shown for group 44 in FIG. 3, so the orientation of the magnetic field is correct.

Prior to pressure stress-relief annealing according to the teachings of the invention, amorphous laminations, as cast, have dimples, ripples, and corrugations which are readily apparent to the eye. After pressure stress-relief annealing, the dimples, ripples and corrugations disappear from the surfaces of the laminations. Profilometer tests on the surfaces of the laminations, before and after pressure flattening, show a definite reduction in the high spots.

Step 22 sets forth the process of constructing a magnetic core for static electrical inductive apparatus, such as a power transformer, from the pressure flattened and stress-relief annealed groups 44 of amorphous laminations 46. After the stress-relief anneal process, the groups 44 of amorphous laminations may be edge bonded, if desired, to aid handling and to prevent the brittle laminations from "shedding" flakes, etc. using an epoxy resin, or other suitable bonding agent. U.S. Pat. No. 3,210,709 discloses edge bonding applied to magnetic cores constructed of conventional grain oriented electrical steel, but the process could also be applied to amorphous laminations if the resin isn't allowed to penetrate between the laminations. For example, a U.V. curable resin may be used so that it may be instantly gelled by ultra violet radiation as soon as the resin is applied.

Since the amorphous laminations are already in small groups by virtue of the pressure anneal process, they may be easily stacked into a core group-by-group, without the necessity of edge bonding. In a preferred embodiment of the invention, the number of laminations in each group 44 determines the number of laminations before the joint arrangement changes. Thus, if there are 10 laminations in each group 44, then 10 adjacent layers of laminations would all have the same joint configuration between the leg and yoke laminations which make up each layer. The next groups of leg and yoke laminations would then establish another joint arrangement, such that the joints between any two adjacent groups of laminations across the core build would not be aligned with one another.

Figure 5:
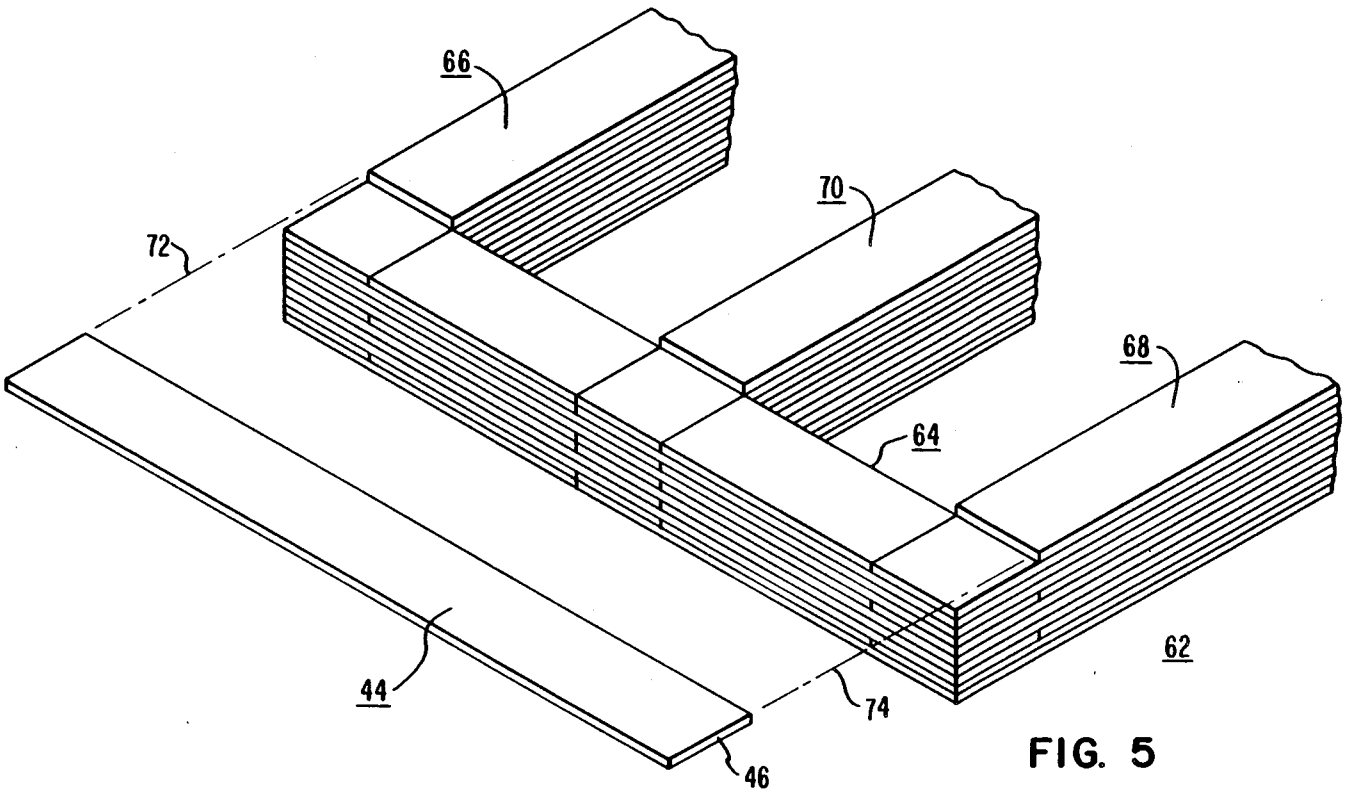
FIG. 5 is a fragmentary perspective view of a magnetic core being stacked with pressure annealed groups of amorphous laminations.

FIG. 5 is a fragmentary, perspective view of a three-phase magnetic core 62 of the core-form type in the process of being constructed according to step 22 of FIG. 1. The invention is equally applicable to single-phase magnetic cores of the core-form type, as well as to single and three-phase cores of the shell-form type. Magnetic core 62 includes a lower yoke portion 64, first and second outer leg portions 66 and 68, respectively, and an inner leg portion 70. As illustrated by arrows 72 and 74 in FIG. 5, group 44 of pressure flattened amorphous laminations 46 is to be placed into position on the lower yoke portion 64, to butt against groups of pressure flattened laminations which have already been placed into position on the leg portions 66, 68, and 70.

Several single-phase I-plate magnetic cores having like build dimensions were constructed of 5.5 inch wide amorphous laminations, processed with and without pressure flattening, and tested to obtain an indication of the value of pressure stress-relief annealing versus no deliberately added pressure during stress-relief anneal. A core was also constructed of pressure flattened amorphous material without the interspersed flattening sheets, to obtain an indication of the improvement provided by the flattening sheets. The test results are shown in FIGS. 6 and 7, with FIG. 6 comparing core losses in watts per pound (W/#) versus induction in kilo-gauss (kG), and with FIG. 7 comparing the core exciting power in volt-amperes per pound (VA/#) versus induction in kG.

Figure 6:
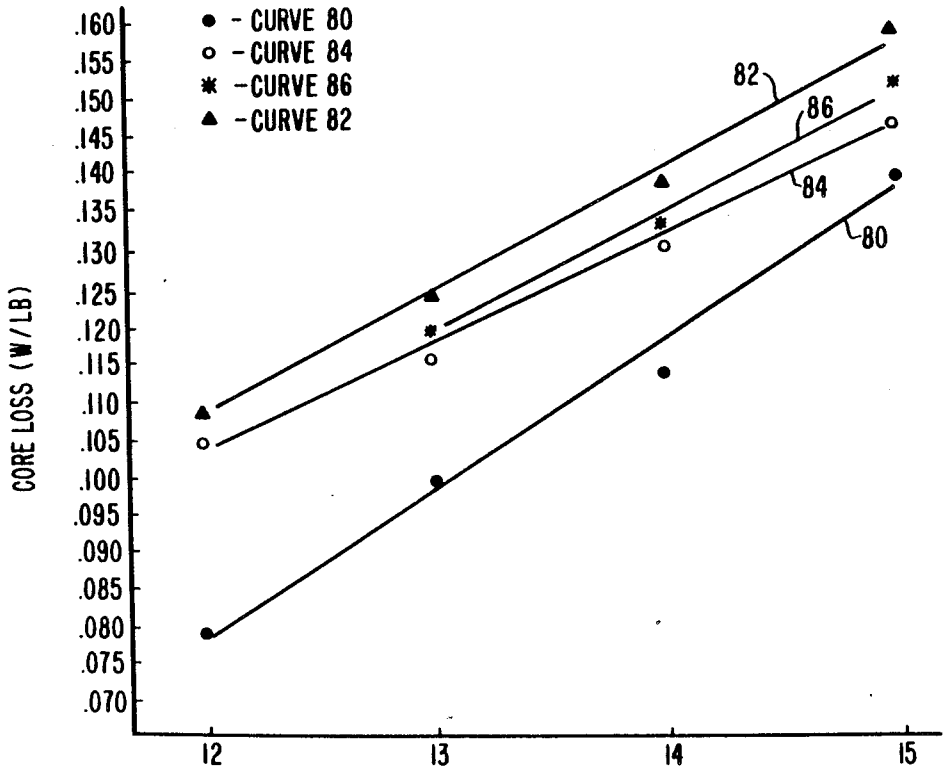
FIG. 6 is a graph comparing core losses versus induction for magnetic cores constructed according to the invention with magnetic cores constructed according to other methods.
Figure 7:
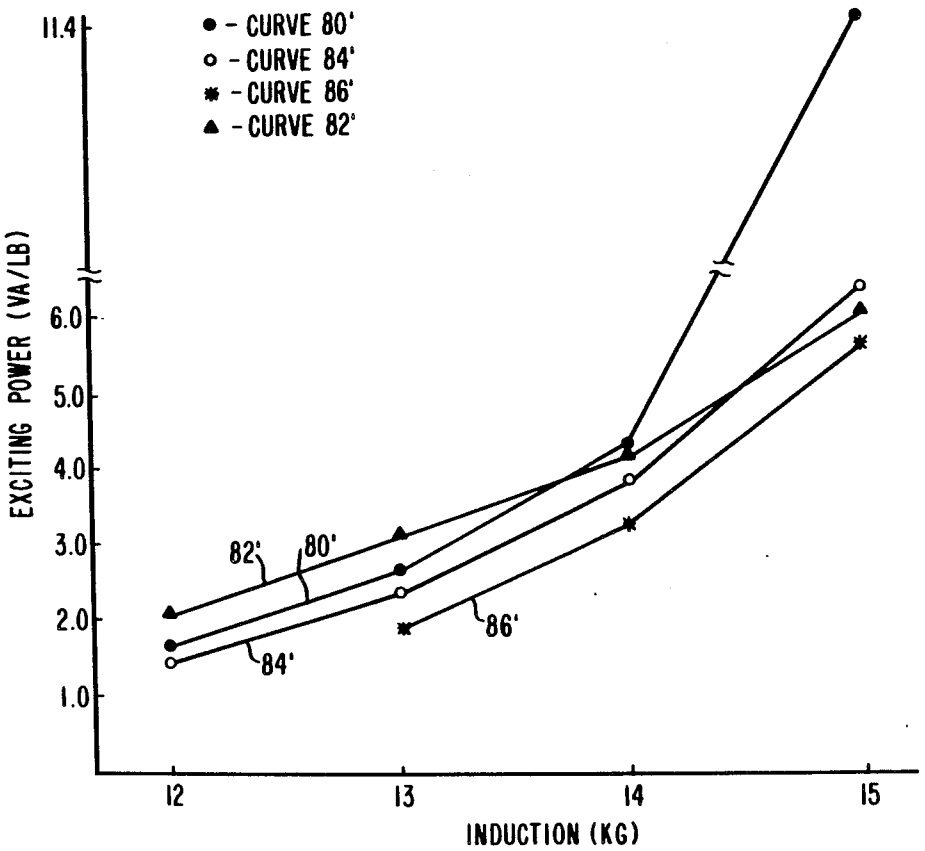
FIG. 7 is a graph similar to the graph of FIG. 6 except comparing exciting power versus induction for the same magnetic cores which supplied the data for the FIG. 6 graph.

Curve 80 in FIG. 6 indicates the core loss of a core constructed according to the teachings of the invention, with 4 psi pressure used during the pressure flattening step. Five amorphous laminations were stacked between adjacent pairs of flattening sheets and, after pressure flattening, the 5 laminations were handled as a group and stacked into a magnetic core. The joint configuration thus remains the same for the 5 laminations of a group and it then changes to a new joint configuration for the next 5 laminations, etc. It will be noted that the watt loss per pound increases with induction. Thus, it is conventional to operate cores constructed of amorphous metal at a lower induction than cores constructed of regular grain oriented material, e.g., about 13 kG for amorphous to about 17.5 kG for regular grain oriented steel.

Curve 82 illustrates the core loss of a core stacked 5 laminations at a time to provide the same pattern of joints as the core which developed the data in curve 80, but the laminations of the core were not subjected to pressure during the stress-relief anneal process. It will be noted that the core losses of the second core are significantly higher at all inductions.

Curve 84 illustrates the core loss of a core which was stacked 1 lamination at a time to change the joint pattern from lamination layer to lamination layer across the core. This is very time consuming and not recommended for production, but was done to obtain data, as this is desirable core construction from the magnetic viewpoint. It will be noted that while the core loss dropped from the core associated with curve 82, that the losses of this third core are still greater at all inductions than the core constructed according to the teachings of the invention.

Curve 86 illustrates the core losses of a core constructed of amorphous laminations which were pressure annealed, but without the benefit of the flattening sheets. It was found that without the flattening sheets that the pressure applied to the thick stack of amorphous laminations transmits the wavy pattern of the as-cast amorphous laminations from the ripples and dimples to a corrugated pattern parallel to the strip length. Interleaving such laminations at the joints results in crossing patterns of such corrugations, resulting in air spaces and a poorer space factor. It will also be noted from curve 86 that the watts loss per pound of this core is substantially higher at all inductions than the core constructed according to the teachings of the invention.

While watts loss per pound is more important than the exciting power, as long as the exciting power is not excessive, the exciting power for the four cores tested to obtain the data for FIG. 6 was also measured and tabulated in FIG. 7. The curves in FIG. 7 have the same reference numbers as the curves in FIG. 6, except for a prime mark, so they may be easily related. It will be noted that the exciting power does not differ greatly between the cores, except the exciting power required by the core constructed according to the teachings of the invention was unusually high at 15 kG. However, as herein-before stated, the amorphous cores are not operated above about 13 kG in practice, so the high reading at 15 kG is not important.

The space factor of the cores whose laminations were annealed under pressure were about 10% better than the cores whose laminations were not annealed under pressure, when measured without clamping pressure on the cores. When measured with clamping pressure, the space factor improvement was about 2% for the cores constructed of the pressure flattened laminations. As will be shown later, the pressure flattened laminations are not nearly as sensitive to the core clamping pressure in the assembled core, compared with cores constructed of amorphous laminations which were not pressure flattened.

Figure 8:
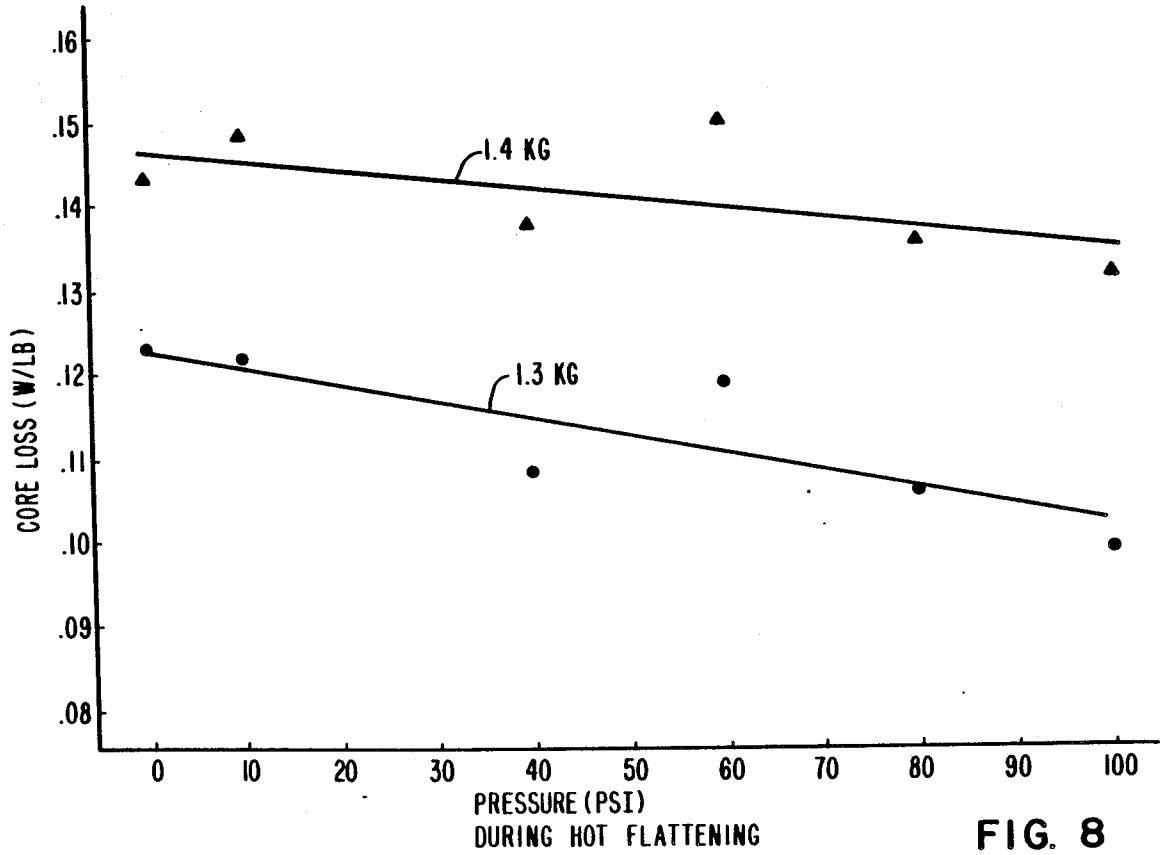
FIG. 8 is a graph which compares core loss versus the pressure used in the pressure annealing method of the invention, for two different inductions.
Figure 9:
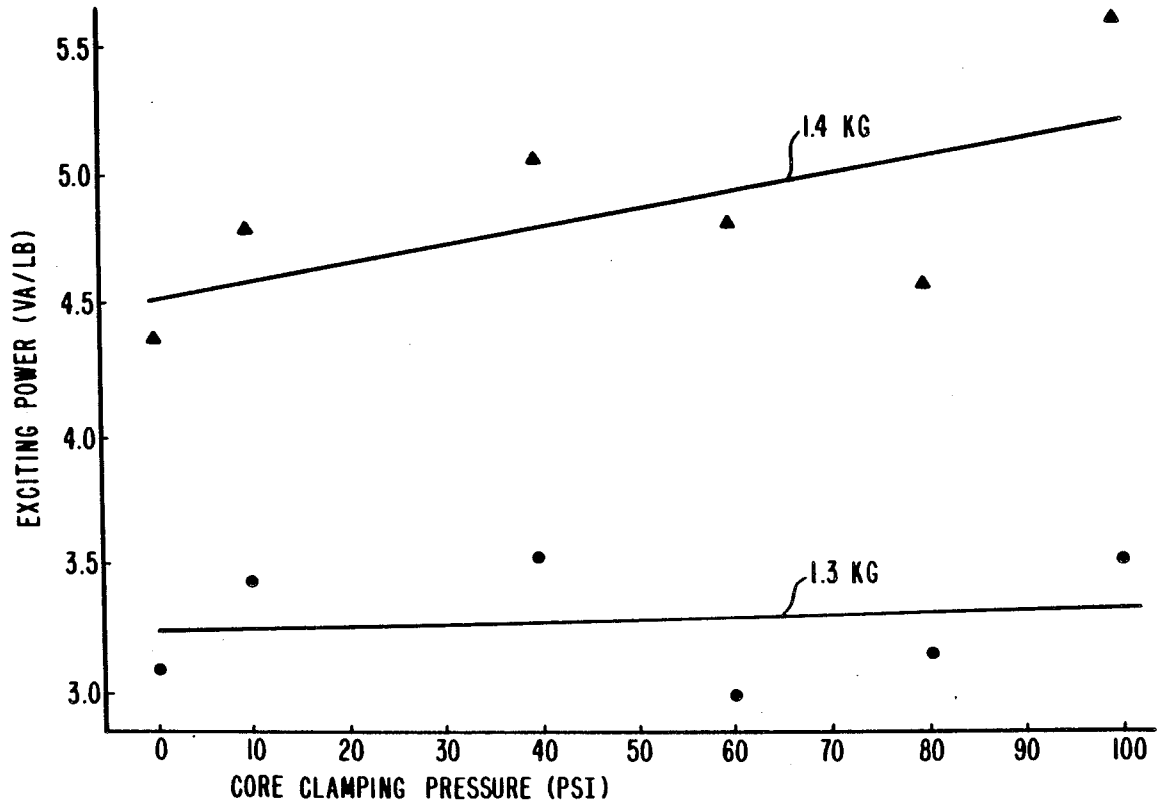
FIG. 9 is a graph which compares exciting power versus core clamping pressure at two different inductions, for a magnetic core constructed of pressure annealed amorphous laminations according to the teachings of the invention.

Test data was also obtained from single phase I-plate cores constructed from 2 inch wide amorphous laminations having a length dimension of 10 inches. The laminations were stacked 7 per group between flattening sheets, with different pressures being applied to different groups to obtain an indication of the effect of pressure magnitude during the hot stress-relief anneal cycle. Cores having a build height of 0.25 inch were then constructed and tested for watts loss per pound and exciting power, resulting in the curves of FIGS. 8 and 9, respectively. FIG. 8 plots core loss versus the pressure utilized during the anneal process, while FIG. 9 plots exciting power versus the core clamping pressure used to hold the leg and yoke portions of the cores constructed from the pressure flattened laminations. It will be noted that the core loss improved with the flattening pressure used during the anneal process. The core space factor also improved with the amount of pressure used during the stress-relief anneal cycle, from about 66 to 71%. While the curves of FIG. 9 indicate that the exciting power increases with core clamping pressure at an induction of 14 kG, the exciting power is essentially unaffected by the core clamping pressure at the recommended induction of 13 kG.

Cores similar to those used to obtain the data for FIGS. 8 and 9 were also constructed using pressure flattened laminations which were flattened with different numbers of laminations per group between the flattening sheets, and then the groups were used to construct the cores. Table I below tabulates the watts loss per pound for the different cores at different inductions, the exciting power, and the space factors.

TABLE I

| LAMINATIONS | INDUCTION (kG) 12 | | 13 | | 14 | | 15 | | SPACE % |
|---|---|---|---|---|---|---|---|---|---|
| GROUP | W/lb. | VA/lb. | W/lb. | VA/lb. | W/lb. | VA/lb. | W/lb. | VA/lb. | FACTOR |
| 5 | .087 | 2.99 | .102 | 4.67 | .117 | 7.18 | .138 | 10.99 | 73.4 |
| 10 | .097 | 4.56 | .116 | 6.90 | .139 | 10.1 | .162 | 13.5 | 75.0 |
| 20 | .118 | 5.21 | .141 | 7.88 | .173 | 11.2 | .209 | 16.5 | 72.1 |
| 30 | .236 | 5.93 | .291 | 8.60 | .334 | 11.5 | .390 | 15.2 | 73.9 |
| 50 | .325 | 5.81 | .405 | 9.36 | .499 | 11.7 | .519 | 16.2 | 78.0 |

TABLE I-continued

| LAMINATIONS GROUP | INDUCTION (kG) 12 W/lb. | 12 VA/lb. | 13 W/lb. | 13 VA/lb. | 14 W/lb. | 14 VA/lb. | 15 W/lb. | 15 VA/lb. | SPACE % FACTOR |
|---|---|---|---|---|---|---|---|---|---|
| 70 | .349 | 7.15 | .434 | 10.7 | .504 | 15.5 | .631 | 21.0 | 78.9 |
| 100 | .649 | 10.4 | .685 | 12.8 | .783 | 17.4 | .918 | 25.3 | 80.0 |

Figure 10:
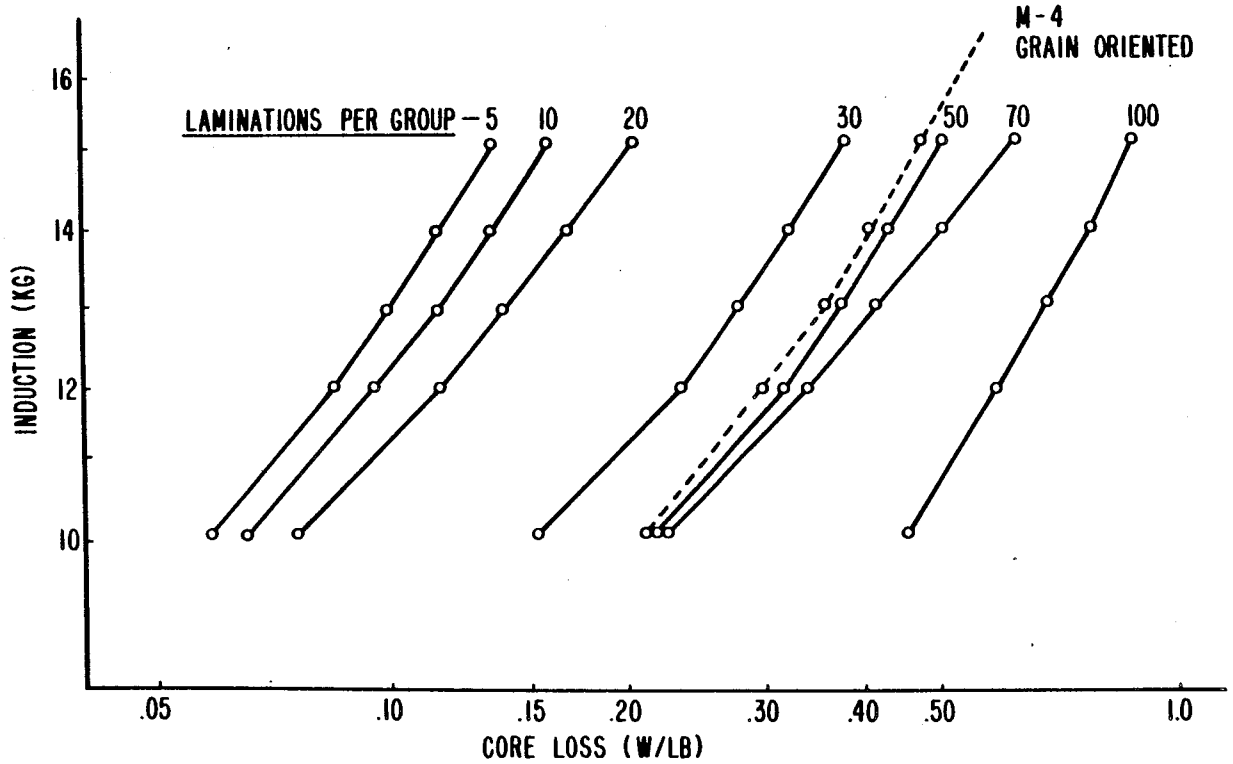
FIG. 10 is a graph comparing induction versus core loss for magnetic cores having different numbers of amorphous laminations per group.

FIG. 10 is a graph which compares induction versus core loss for the cores stacked with different numbers of laminations per group, using the data from Table I. It is clear from FIG. 10 that the number of laminations per group should generally be between 5 and 10. The broken line curve in FIG. 10 was developed from data taken with a core constructed of M-4 regular grain oriented steel for comparison with the amorphous cores. It will be noted that with 50 amorphous laminations per group that the advantage of amorphous is lost. Since amorphous costs more per pound than regular grain oriented steel, to obtain any advantage by using the amorphous metal, the number of laminations per group should not be more than 20, and preferably between 5 and 10.

In summary, there has been disclosed a new and improved method of constructing a magnetic core from amorphous metal laminations, which improves the core space factor and the core loss (W/#) without adversely affecting the exciting power (VA/#) of the core. In fact the pressure stress-relief anneal process of the invention makes the cores substantially less sensitive to the core clamping pressure used to consolidate the assembled cores.

We claim as our invention:

1. A method of constructing laminations of an amorphous alloy, suitable for use in a magnetic core for static electrical inductive apparatus, to improve the core space factor, to reduce core losses, and to reduce the sensitivity of the amorphous laminations to core clamping pressures, comprising the steps of:

cutting laminations from a strip of amorphous alloy, stacking said amorphous laminations, to provide a stack of laminations, said stacking step including the step of dividing said stack of laminations into a plurality of groups by interspersing rigid flattening sheets between the groups, with the surfaces of said rigid flattening sheets which contact the amorphous laminations being smoother than the surfaces of the amorphous laminations, and with the thickness dimension of each of said rigid flattening sheets exceeding the thickness dimension of each of said amorphous laminations, and subjecting said stack of amorphous laminations to a heating-cooling cycle which includes the steps of:

heating said stack of grouped laminations to a predetermined temperature, below the crystallization temperature of the amorphous alloy, which temperature is sufficient to stress relief anneal the amorphous alloy, providing an inert atmosphere about said stack of amorphous laminations during said heating step, pressing said stack of grouped laminations during said heating step to provide a pressure of at least 4 psi, but below the pressure which would initiate metallurgical bonding of adjacent laminations, cooling said stack of grouped laminations, and applying a saturating magnetic field to said stack of grouped laminations, at least during a portion of said heating-cooling cycle.

2. The method of claim 1 wherein the step of applying a saturating magnetic field to the stack of amorphous laminations applies the magnetic field during both the heating and cooling steps.

3. The method of claim 1 wherein the step of heating the stack of amorphous laminations, includes the step of holding the stack of amorphous laminations at a predetermined temperature for a predetermined period of time.

4. The method of claim 1 wherein the step of interspersing flattening sheets in the stack of amorphous laminations includes the step of selecting such flattening sheets from strips of grain oriented electrical steel having a thickness dimension in the range of about 7 to 12 mils.

5. The method of claim 4 wherein the laminations of amorphous alloy have predetermined length and width dimensions, and wherein the step of selecting flattening sheets selects sheets which have length and width dimensions which exceed the predetermined length and width dimensions of the laminations of amorphous alloy.

6. The method of claim 5 wherein the stacking step aligns a predetermined edge of each of the flattening sheets with a predetermined edge of the stack of amorphous laminations.

7. The method of claim 4 wherein the stacking step stacks first and second stacks of amorphous laminations in spaced relation, with the dividing step simultaneously dividing both the first and second stacks of amorphous laminations into groups by selecting the dimensions of the flattening sheets such that each flattening sheet covers both the first and second stacks of amorphous laminations.

8. The method of claim 1 wherein the step of dividing the stack of amorphous laminations into groups divides the stack into groups of about 5 to 10 amorphous laminations.

9. The method of claim 1 including the step of bonding predetermined edges of each group of amorphous laminations, after the cooling step.

10. The method of claim 1 wherein the step of stacking the amorphous laminations includes the step of aligning the edges of the amorphous laminations.

* * * * *